US010543953B2

(12) United States Patent
Hasegawa

(10) Patent No.: US 10,543,953 B2
(45) Date of Patent: Jan. 28, 2020

(54) STORAGE CASE

(71) Applicant: SONY CORPORATION, Tokyo (JP)

(72) Inventor: Chikako Hasegawa, Tokyo (JP)

(73) Assignee: SONY CORPORATION, Tokyo (JP)

( * ) Notice: Subject to any disclaimer, the term of this patent is extended or adjusted under 35 U.S.C. 154(b) by 10 days.

(21) Appl. No.: 15/754,207

(22) PCT Filed: Jul. 4, 2016

(86) PCT No.: PCT/JP2016/003173
§ 371 (c)(1),
(2) Date: Feb. 21, 2018

(87) PCT Pub. No.: WO2017/043001
PCT Pub. Date: Mar. 16, 2017

(65) Prior Publication Data

US 2018/0251257 A1 Sep. 6, 2018

(30) Foreign Application Priority Data

Sep. 10, 2015 (JP) ..... 2015-178093

(51) Int. Cl.
*B65D 5/50* (2006.01)
*B65D 5/62* (2006.01)
(Continued)

(52) U.S. Cl.
CPC ..... *B65D 5/50* (2013.01); *B65D 5/62* (2013.01); *B65D 5/66* (2013.01); *B65D 81/05* (2013.01)

(58) Field of Classification Search
CPC ..... B65D 5/22; B65D 5/46; B65D 5/4604; B65D 5/4624; B65D 5/5054; B65D 5/62;
(Continued)

(56) References Cited

U.S. PATENT DOCUMENTS 2,351,207 A * 6/1944 Henderson ..... B65D 5/4616 229/117.15
2,981,458 A * 4/1961 Thibault ..... B65D 5/46016 229/117.24
(Continued)

FOREIGN PATENT DOCUMENTS

JP 51-502 A 1/1976
JP 51-502 Y1 1/1976
(Continued)

OTHER PUBLICATIONS

International Search Report and Written Opinion of PCT Application No. PCT/JP2016/003173, dated Aug. 30, 2016, 09 pages.

*Primary Examiner* — Bryon P Gehman
(74) *Attorney, Agent, or Firm* — Chip Law group

(57) ABSTRACT

To improve operability when an object to be stored is taken-out and stored and portability. A main case includes a first bottom-plate, a first side-wall, and a first space. The first side-wall includes four sides including a first side. The first side-wall includes a first side-plate opposite to the first side and is connected with three sides different from the first side. The first space is partitioned by the first bottom-plate and the first side-wall. The cap includes a second bottom-plate, a second side-wall, and a second space. The second side-wall has four sides including a second side. The second side-wall includes a second side-plate opposite to the second side and is connected with three sides different from the second side. The second space is partitioned by the second bottom-plate and the second side-wall and has a volume larger than a volume of the first space. The connection plate is connected with each of the first side and the second side and is foldable to the first bottom-plate and the second bottom-plate. The grip member is attached to the first side-plate and is capable
(Continued)

of penetrating into the second side-plate in a closed state in which the first side-wall is housed in the second space.

8 Claims, 11 Drawing Sheets

(51) Int. Cl.
*B65D 81/05* (2006.01)
*B65D 5/66* (2006.01)

(58) Field of Classification Search
CPC ..... B65D 5/66; B65D 5/6667; B65D 5/68; B65D 81/05; B65D 81/127; B65D 5/50
USPC ..... 206/320, 521, 523, 588, 592; 229/117.14, 117.23, 117.24
See application file for complete search history.

(56) References Cited

U.S. PATENT DOCUMENTS 4,403,695 A * 9/1983 Raymoure ..... B65D 75/004 206/497
5,144,914 A * 9/1992 Giannakopoulos .. A01K 1/0107 229/117.24
6,305,539 B1 * 10/2001 Sanders, Jr. ..... B65D 5/6664 206/320
7,367,490 B2 * 5/2008 Forthaus ..... B65D 5/2066 229/117.24
8,627,958 B2 * 1/2014 McDonald ..... B65D 5/22 206/583
2011/0297561 A1 * 12/2011 Justice ..... B65D 5/4604 229/117.24

FOREIGN PATENT DOCUMENTS

JP 58-17317 U 2/1983
JP 5817317 U 2/1983
JP 63-3943 U 1/1988
JP 03-32018 U 3/1991
JP 09-301351 A 11/1997
JP 11-59667 A 3/1999
JP 11-059667 A 3/1999
JP 3182603 U 4/2013

* cited by examiner

STORAGE CASE

CROSS REFERENCE TO RELATED APPLICATIONS

This application is a U.S. National Phase of International Patent Application No. PCT/JP2016/003173 filed on Jul. 4, 2016, which claims priority benefit of Japanese Patent Application No. JP 2015-178093 filed in the Japan Patent Office on Sep. 10, 2015. Each of the above-referenced applications is hereby incorporated herein by reference in its entirety.

TECHNICAL FIELD

The present technology relates to a storage case used for packaging, storing, or the like of an electronic device, for example.

BACKGROUND ART

For example, as a storage case used for packaging or storing an electronic device, there is known a paper carton made by folding and assembling a cardboard paper sheet. For example, Patent Literature 1 discloses a packing box including a main case having a bottom-plate, both side-plates at long sides, and both side-walls at short sides, and a top-plate connected openably and closably with at an upper end of the side-plate at one short side.

CITATION LIST

Patent Literature

Patent Literature 1: Japanese Patent Application Laid-open No. 9-301351

DISCLOSURE OF INVENTION

Technical Problem

However, the structure disclosed in Patent Literature 1, the main case may tilt due to the weight of the top-plate when the top-plate is open. Therefore, taken-out operability and storing operability of an object to be stored are poor. In addition, this type of the packing box often needs both hands for transportation, and portability is therefore not good.

The present technology is made in view of the above-mentioned circumstances, and it is an object of the present technology to provide a storage case capable of improving operability when an object to be stored is taken-out and stored, and portability.

Solution to Problem

A storage case according to an embodiment of the present technology includes a main case, a cap, a connection plate, and a grip member.

The main case includes a first bottom-plate, a first side-wall, and a first space. The first side-wall includes four sides including a first side. The first side-wall includes a first side-plate opposite to the first side and is connected with three sides different from the first side. The first space is partitioned by the first bottom-plate and the first side-wall.

The cap includes a second bottom-plate, a second side-wall, and a second space. The second side-wall has four sides including a second side. The second side-wall includes a second side-plate opposite to the second side and is connected with three sides different from the second side. The second space is partitioned by the second bottom-plate and the second side-wall and has a volume larger than a volume of the first space.

The connection plate is connected with each of the first side and the second side and is foldable to the first bottom-plate and the second bottom-plate.

The grip member is attached to the first side-plate and is capable of penetrating into the second side-plate in a closed state in which the first side-wall is housed in the second space.

Since the connection plate is foldably to the first bottom-plate and the second bottom-plate, the main case and the cap of the storage case can be horizontally positioned at the time of opening. With this, operability when the object to be stored is taken-out and stored can be improved. In addition, the grip member can prevent the cap from carelessly opening and the portability of the case to be improved.

The main case, the cap, and the connection plate typically includes a first cardboard paper sheet. In this case, the first side-wall and the second side-wall may have a multilayer structure of the first cardboard paper sheet. With this, the weight of the entire case can be reduced, and the stiffness of the entire case can be improved.

The first cardboard paper sheet has a first plate forming an inner surface of the second side-plate and a pair of second plates forming inner surfaces of a pair of side-plates adjacent to the second side-plate. In this case, the first plate has a pair of cut-out portions. The pair of cut-out portions are arranged at both side edges adjacent to the pair of second plates and formed to each have a depth corresponding to the thickness of the first plate. The pair of second plates have protrusions that engage with the pair of cut-out portions.

This can prevent the protrusions from folding, and an adequate fitting state of the main case and the cap is ensured upon storage.

The connection plate may have a multilayer structure of the first cardboard paper sheet.

This allows the stiffness of the connection plate to be improved, to which the largest load is applied, when the grip member is gripped and the storage case is carried.

The storage case may further include a cushion member. The cushion member is positioned in the first space and partitions a storage room having a volume smaller than the first space. With this, the object to be stored can be protected from a shock and stably kept in the storage case inside.

In this case, the cushion member may have a third bottom-plate facing to the first bottom-plate and a third side-wall facing to the first side-plate into which the grip member is capable of entering.

With this, the grip member is sufficiently flattened, and the cap can be easily open and closed.

Furthermore, the cushion member may include a second cardboard paper sheet. In this case, the third side-walls may include a multilayer structure of the second cardboard paper sheet. With this, the grip member is not protruded toward the storage room and can be flattened along with the second side-plate.

Furthermore, the third side-walls may further include a fourth side-plate facing to the third side-plate that is overlapped with the connection plate in the closed state, a fifth side-plate arranged between the third side-plate and the fourth side-plate, and a partitioning plate facing to the fifth side-plate that partitions the storage room into a plurality of storage rooms. In this case, the fifth side-plate includes more layers than the partitioning plate.

With this, it is possible to ensure cushioning properties of the fifth side-plate and to increase the volume of the storage room.

The storage case may further include a damping sheet. The damping sheet is arranged at the second bottom-plate and comes in contact with the cushion member in the closed state.

With this, a shock damping action can be improved toward the object to be stored.

The storage case may further include a cover sheet. The cover sheet is held on the second side-wall and arranged at an outer surface of the cap.

With this, cover sheet can be easily attached or detached.

Advantageous Effects of Invention

As described above, according to the present technology, operability when an object to be stored is taken-out and stored, and portability can be improved.

It should be noted that the effects described here are not necessarily limitative and may be any of effects described in the present disclosure.

MODE(S) FOR CARRYING OUT THE INVENTION

Hereinafter, embodiments of the present disclosure will be described with reference to the drawings.

First Embodiment

Figure 1:
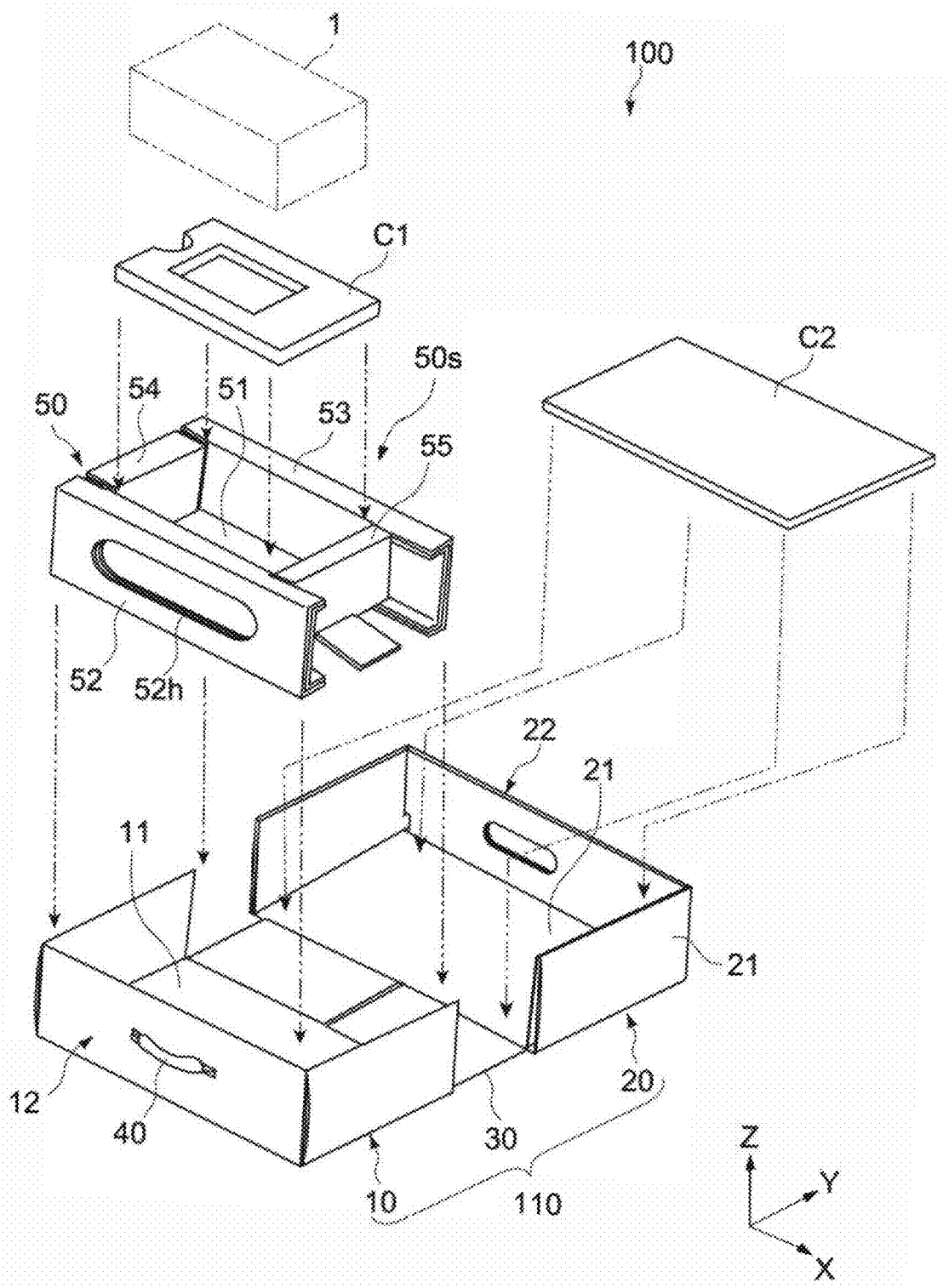
FIG. 1 is an exploded perspective view showing a storage case according to an embodiment of the present technology.

FIG. 1 is an exploded perspective view showing a storage case according to an embodiment of the present technology.

Note that the X axis, the Y axis, and the Z axis represent three-axis directions orthogonal to each other in each drawing, and here, the X axis and the Y axis directions correspond to the horizontal directions (the same shall apply to the drawings hereinafter).

A storage case 100 according to this embodiment includes a carton 110 made of paper having a main case 10, a cap 20, and a connection plate 30, and a grip member 40 attached to the main case 10. The storage case 100 further includes a cushion member 50 housed in the main case 10.

The storage case 100 is typically used for packaging, storing, or the like of an electronic device 1. Examples of an object to be stored are not limited to the electronic device 1, and may include, for example, industrial products such as machine parts and measurement devices, daily commodities such as dishes, crafts, art works, and the like.

Hereinafter, each part will be described in detail.

[Carton]

As shown in FIG. 1, the carton 110 includes a unit of the main case 10, the cap 20, and the connection plate 30. The main case 10 and cap 20 are connected together via the connection plate 30. The main case 10, the cap 20, and the connection plate 30 are made of one common cardboard paper sheet.

Figure 2:
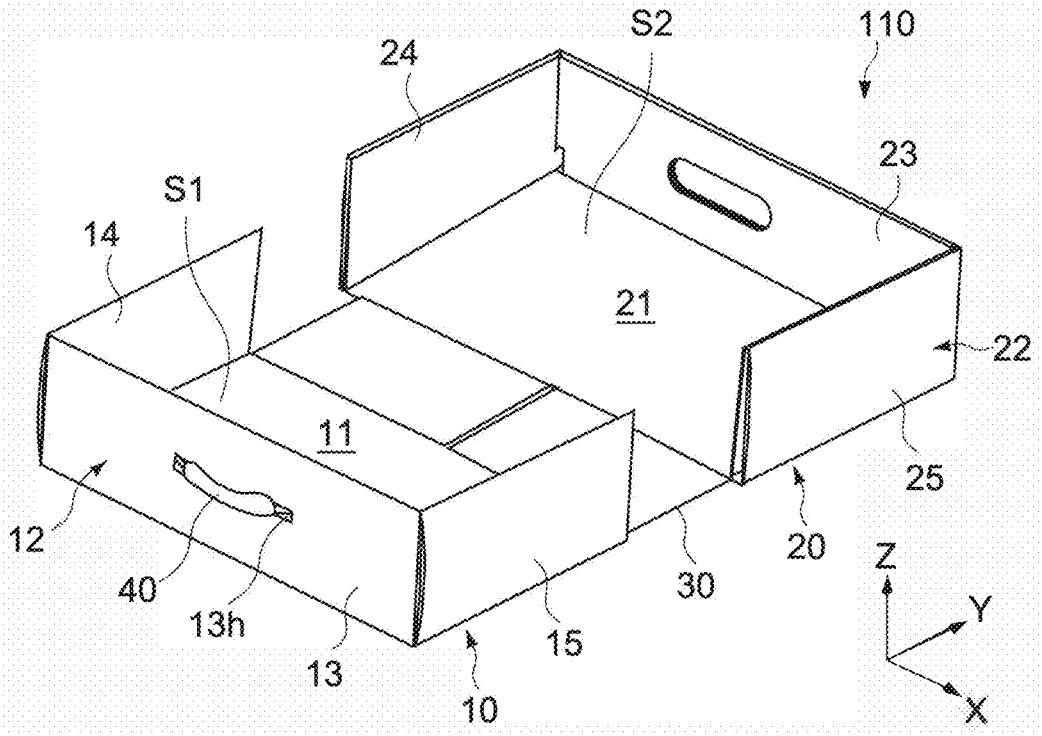
FIG. 2 is a perspective view showing a carton in an open state.
Figure 3:
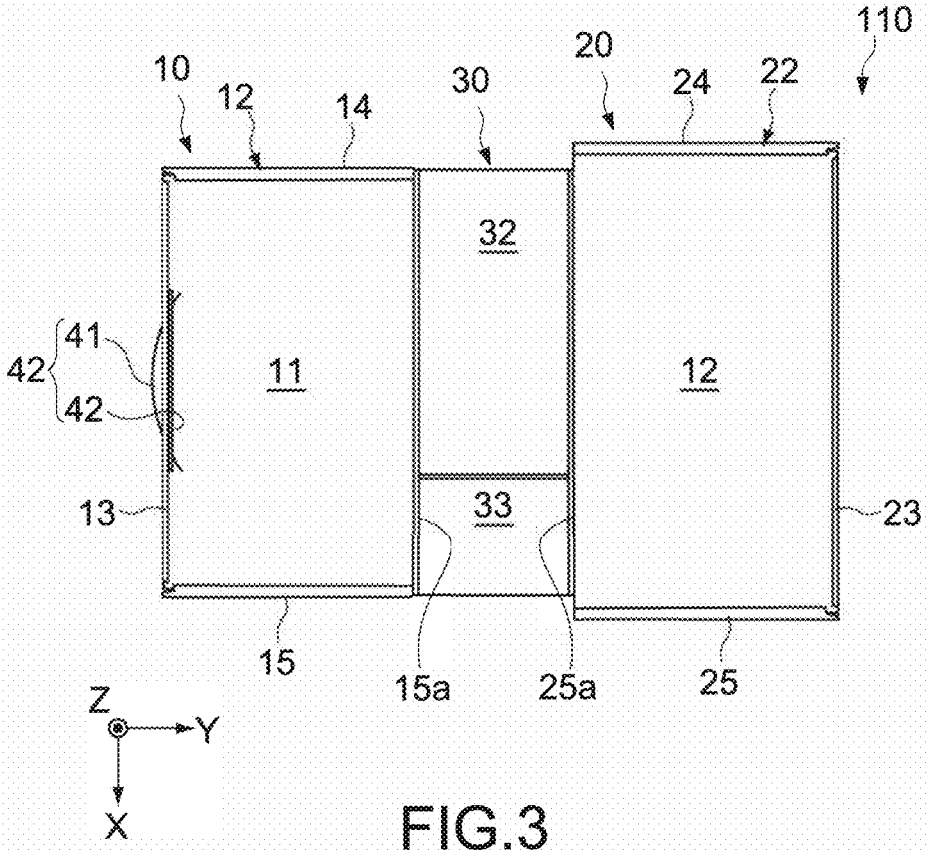
FIG. 3 is a plan view of the carton.
Figure 4:
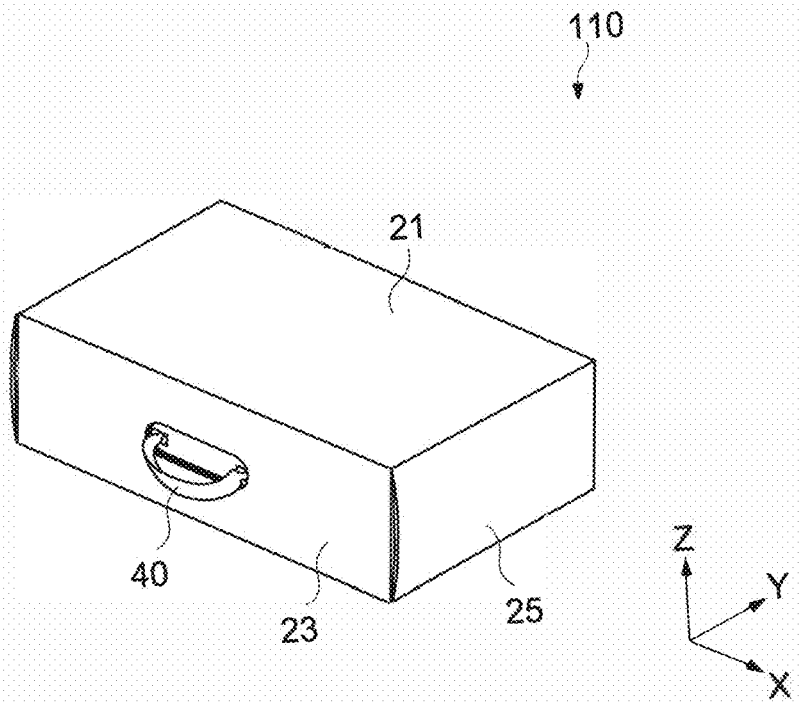
FIG. 4 is a perspective view showing the carton in a closed state.
Figure 5:
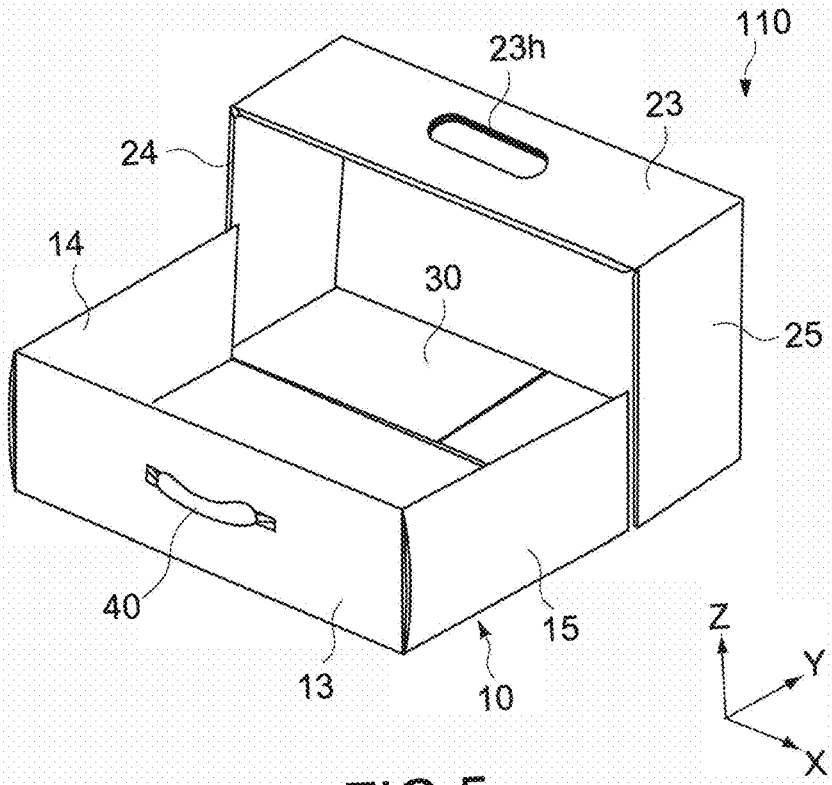
FIG. 5 is a perspective view showing the carton in an intermediate state between the open state and the closed state.
Figure 6:
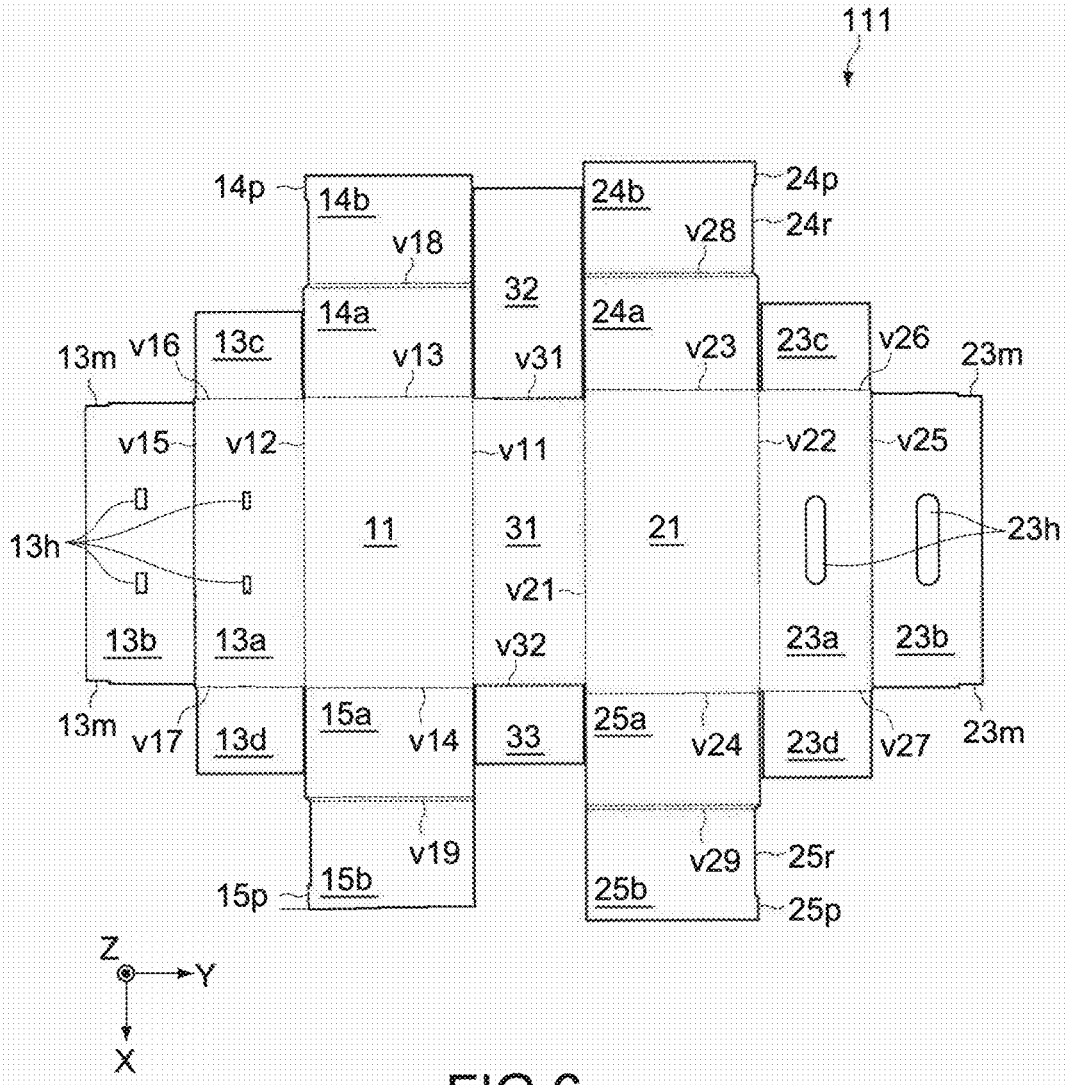
FIG. 6 is a development view of the carton.

FIG. 2 is a perspective view showing the carton 110 in an open state, FIG. 3 is a plan view showing the carton 110, FIG. 4 is a perspective view showing the carton 110 in a closed state, FIG. 5 is a perspective view showing the carton 110 in an intermediate state between the open state and the closed state, and FIG. 6 is a development view showing the carton 110. Note that dotted lines represent folding lines in FIG. 6.

The carton 110 is made by folding one cardboard paper sheet 111 (first cardboard paper sheet) shown in FIG. 6 in a predetermined shape. The ridge-extending direction of the cardboard paper sheet 111 is the X axis direction in this embodiment. The carton 110 can be arbitrarily opened or closed between the open state that the main case 10 and the cap 20 are separated each other (see FIG. 2, FIG. 3, and FIG. 5) and the closed state that the main case 110 and the cap 20 are unitized together (see FIG. 4).

(Main Case)

As shown in FIG. 2, the main case 10 has a rectangular bottom-plate 11 (first bottom-plate) and a side-wall 12 (first side-wall) connected with three sides of the bottom-plate 11, and a space S1 (first space) is partitioned by the bottom-plate 11 and the side-wall 12. The side-wall 12 has a front-plate 13 (first side-plate), to which the grip member 40 is attached, and left and right side-plates 14 and 15. The side-plates 14 and 15 have the same height as the front-plate 12.

As shown in FIG. 6, the bottom-plate 11 has four sides v11 to v14, and a rear surface 31, which is a part of the connection plate 30, is foldably connected with one long side v11 (first side).

A rectangular plate 13*a* forming the outer surface of the front-plate 13 is connected with the other long side v12 of the bottom-plate 11. Plates 13*b*, 13*c*, and 13*d* are connected with another long side v15 and both short sides v16 and v17 of the plate 13*a*, respectively.

The front-plate 13 has a multilayer structure where a plurality of plates are overlaid and is made by folding back the plate 13*b* toward the plate 13*a* at the long side v15. The plate 13*b* forms an inner surface of the front-plate 13 and has the similar shape as the plate 13*a*. At substantially center portions of the plates 13*a* and 13*b*, insertion holes 13*h* are respectively formed, into which both ends of the grip member 40 are penetrated.

One plate 13*c* is folded at about 90 degrees at the short side v16 and inserted into two plates 14*a* and 14*b* of a side-plate 14. The other plate 13*d* is folded at about 90 degrees at the short side v17 and are inserted into two plates 15*a* and 15*b* of a side-plate 15. The plates 13*c* and 13*d* reinforce the side-plates 14 and 15 and are for fixing the state that the front-plate 13 is folded at about 90 degrees at the long side v12, each of which has a width (length along the X axis direction) shorter than the length (length along the Y axis direction) of the side-plates 14 and 15 in FIG. 6.

The side-plates 14 and 15 are formed by folding rectangular plates 14*a* and 15*a* connected with both the short sides v13 and v14 of the bottom-plate 11. The side-plates 14 and 15 each has a multilayer structure where a plurality of plates are overlaid and are formed of laminates of the plates 14*a* and 15*a*, the plates 14*b* and 15*b* folded at the long sides v18 and v19 thereof, and the plates 13*c* and 13*d*. The plates 14*a* and 15*a* form respective outer surfaces of the side-plates 14 and 15, and the plates 14*b* and 15*b* form respective inner surfaces of the side-plates 14 and 15.

(Cap)

As shown in FIG. 2, the cap 20 includes a rectangular bottom-plate 21 (second bottom-plate) and a side-wall 22 (second side-wall) connected with three sides of the bottom-plate 21, and a space S2 (second space) is partitioned by the bottom-plate 21 and the side-wall 22. The side-wall 22 has a front-plate 23 (second side-plate) into which the grip member 40 is penetrated and left and right side-plates 24 and 25. The side-plates 24 and 25 have the same height as the front-plate 23. In addition, the side-wall 22 is higher than the side-wall 12 of the main case 10.

As shown in FIG. 6, the bottom-plate 21 has four sides v21 to v24, and a rear surface 31, which is a part of the connection plate 30, is foldably connected with one long side v21 (second side).

A rectangular plate 23*a* forming the outer surface of the front-plate 23 is connected with the other long side v22 of the bottom-plate 21. Plates 23*b*, 23*c*, and 23*d* are connected with another long side v25 and both short sides v26 and v27 of the plate 23*a*, respectively.

The front-plate 23 has a multilayer structure where a plurality of plates are overlaid and is made by folding back the plate 23*b* toward the plate 23*a* at the long side v25. The plate 23*b* forms an inner surface of the front-plate 23 and has the similar shape as the plate 23*a*. At substantially center portions of the plates 23*a* and 23*b*, insertion holes 23*h* are formed into which the grip member 40 can be penetrated.

One plate 23*c* is folded at about 90 degrees at the short side v26 and inserted into two plates 24*a* and 24*b* of a side-plate 24. The other plate 23*d* is folded at about 90 degrees at the short side v27 and inserted into two plates 25*a* and 25*b* of a side-plate 25. The plates 23*c* and 23*d* reinforce the side-plates 24 and 25, are for fixing the front-plate 23 to the state that the front-plate 23 is folded of folded at about 90 degrees at the long side v22, and each has a width (length along the X axis direction) shorter than the length (length along the Y axis direction) of the side-plates 24 and 25 in FIG. 6.

The side-plates 24 and 25 are formed by folding rectangular plates 24*a* and 25*a* connected with both the short sides v23 and v24 of the bottom-plate 21. The side-plates 24 and 25 each has a multilayer structure where a plurality of plates are overlaid and are formed of laminates of the plates 24*a* and 25*a*, the plates 24*b* and 25*b* folded at the long sides v28 and v29 thereof, and the plates 23*c* and 23*d*. The plates 24*a* and 25*a* form respective outer surfaces of the side-plates 24 and 25, and the plates 24*b* and 25*b* form respective inner surfaces of the side-plates 24 and 25.

As described above, the cardboard paper sheet 111 has the plate 23*b* (first plate) forming an inner surface of the side-plate 23 and a pair of plates 24*b* and 25*b* (second plates) forming inner surfaces of a pair of side-plates 24 and 25 adjacent to the side-plate 23. As shown in FIG. 6, the plate 23*b* has a pair of cut-out portions 23*m* arranged at both side edges adjacent to the pair of plates 24*b* and 25*b*. Each cut-out portion 23*m* is formed with a depth corresponding to the thickness of the plate 23*b* (length along the X axis direction).

On the other hand, the pair of plates 24*b* and 25*b* have respective protrusions 24*p* and 25*p* that engage with the cut-out portions 23*m*. The protrusions 24*p* and 25*p* are formed at one ends of side edges of the plates 24*b* and 25*b* facing to the inner surface (plate 23*b*) of the side-plate 23. At the side edges of the plates 24*b* and 25*b*, recesses 24*r* and 25*r* having depths, for example, similar to the depths of the cut-out portions 23*m* are formed, which form the protrusions 24*p* and 25*p*.

Figure 7A:
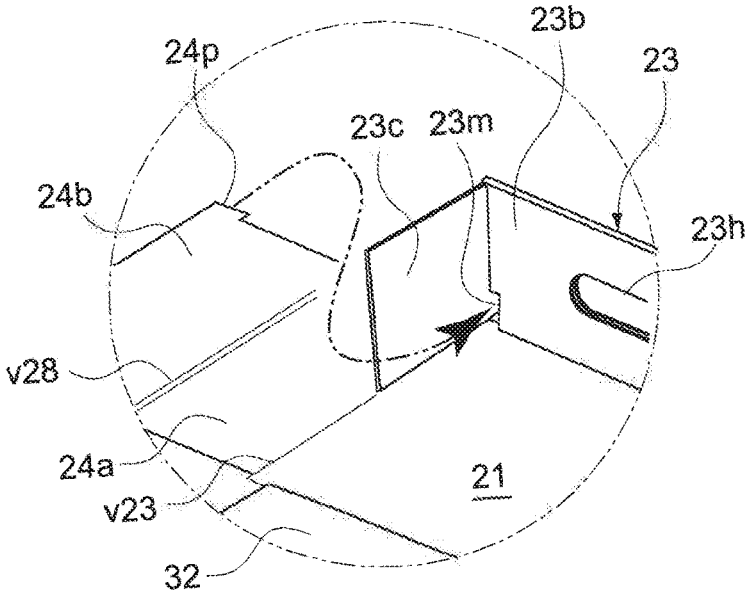
FIGS. 7A and 7B are perspective views showing a main part of a side-plate for illustrating a procedure of assembling the side-plate into a front-plate of the carton.
Figure 7B:
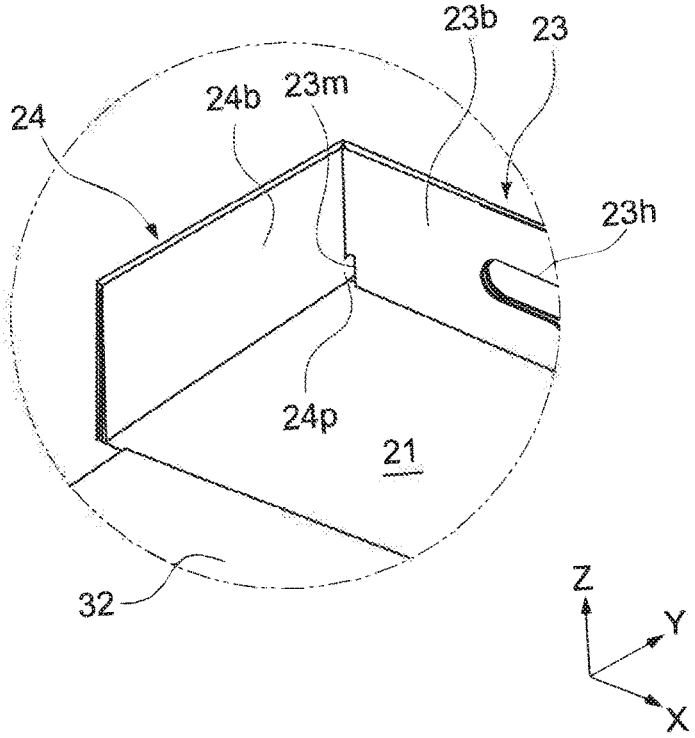

FIGS. 7A and 7B each is a perspective view showing a main part of the side-plate 24 for illustrating a procedure of assembling the side-plate 24 into the front-plate 23.

As shown in FIG. 7A, the plates 23*a* to 23*c* are firstly folded to form the front-plate 23, and the cut-out portions 23*m* of the plate 23*b* is arranged at a boundary between the plate 23*c* and the bottom-plate 21. Then, as shown in FIG. 7B, the plates 24*a* and 24*b* are folded so as to wrap the plate 23*c* to form the side-plate 24 and to engage the protrusion 24*p* with the cut-out portion 23*m*. As a result, the front-plate 23 and the side-plate 24 are faced each other in the X axis direction and the Y axis direction, and a fixed structure that keeps the shown assembled shape of the front-plate 23 and the side-plate 24 can be provided.

Note that the protrusion 25*p* is similarly engaged with the cut-out portion 23*m* such that the side-plate 25 is fixed to the front-plate 23. In addition, the fixed structure is similarly applied for fixing between the front-plate 13 and both the side-plates 14 and 15 of the main case 10. As shown in FIG. 6, the front-plate 13 is provided with a pair of cut-out portions 13*m*, and the side-plates 14 and 15 are provided with protrusions 14*p* and 15*p* engageable with the cut-out portions 13*m*, respectively.

The space S2 of the cap 20 has a volume larger than a volume of the space S1 of the main case 10, and, as shown in FIG. 4, the cap 20 has a size capable of housing the main case 10 inside. Specifically, the bottom-plate 21 of the cap 20 has an area larger than an area of the bottom-plate 11 of the main case 10, and the side-walls 24 and 25 of the cap 20 are formed higher than the side-walls 14 and 15 of the main case 20.

Note that size tolerance among each component of the main case 10 and the cap 20 is not especially limited and can be determined appropriately depending on the size and the shape of the carton 110, the thickness of the cardboard paper sheet 111, the number of layers of the side-walls 12 and 22 or the like.

(Connection Plate)

As described above, the connection plate 30 is connected with each of one long side v11 (first side) of the bottom-plate 11 of the main case 10 and one long side v21 (second side) of the bottom-plate 21 of the cap 20 and is foldable to the bottom-plates 11 and 21. The connection plate 30 is formed to have a length (length along in the Y axis direction of FIG. 2) longer than the height of each of the side-walls 12 and 22 (length along the Z axis direction of FIG. 2).

The connection plate 30 forms the rear of the carton 110 and has a multilayer structure including the rear surface 31 where two plates 32 and 33 each connected with two short sides v31 and v32 are overlaid. The rear surface 31 forms an outer surface of the connection plate 30, and the two plates 32 and 33 form an inner surface of the connection plate 30. The connection plate 30 is made by folding back the respective plates 32 and 33 toward the rear surface 31 at the short sides v31 and v32.

The plates 32 and 33 are for reinforcing the connection plate 30, and a sum of the widths (lengths along the X axis direction) is shorter than the width of the connection plate 30 in FIG. 6. The position where the ends of the plates 32 and 33 are faced may be a center of the connection plate 30 or may not be a center as shown in FIG. 3.

(Grip Member)

The grip member 40 is attached to the front-plate 13 (first side-plate) of the main case 10. The grip member 40 is capable of penetrating into the insertion holes 23*h* of the front-plate 23 (second side-plate) of the cap 20 in a closed state in which the side-wall 12 (first side-wall) of the main case 10 is housed in the space S2 (second space) of the cap 20.

As shown in FIG. 3, the grip member 40 includes a unit of a handle 41 and supports 42.

The handle 41 is made of a plastic deformable plate material having a longitudinal direction in the X axis direction. Both ends of the handle 41 are inserted into the space S1 though the respective insertion holes 13*h* of the front-plate 13 (FIG. 2). The supports 42 are made of a plastic plate material having a longitudinal direction in the X axis direction and include insertion holes faced to an inner surface of the front-plate 13 (plate 13*b*) into which both the ends of the handle 41 are inserted. Both the ends of the handle 41 are provided with locking pieces for preventing the supports 42 from disengaging from the insertion holes. As a result, the handle 41 can be deformed between a normal position where the handle 41 is protruded from the front-plate 13 and supported by the supports (see FIG. 4) and a standby position where the handle 41 enters into the front-plate 13 (see FIG. 5).

(Cushion Member)

The cushion member 50 fits into the inner surface of the side-wall 12 of the main case 10 and is positioned in the space S1 of the main case 10. The cushion member 50 partitions a storage room 50*s* having a volume smaller than the space S1.

The cushion member 50 functions as a damping member that protects the electronic device 1 housed in the storage room 50*s* from a shock. As a result, the electronic device 1 can be protected from a shock and stably kept in the storage case 100 inside. In addition, the cushion member 50 arranged in the main case 10 also has a function of improving stiffness of the main case 10. As a result, the carton 110 is prevented from losing the shape.

As shown in FIG. 1, the cushion member 50 includes a rectangular bottom-plate 51 (third bottom-plate) and side-walls (52 to 55) (third side-walls) connected with four sides of the bottom-plate 51. The side-walls have a front-plate 52 (third side-plate), a back plate 53 (fourth side-plate), a side-plate (fifth side-plate) arranged therebetween, and a side-plate 55 (partitioning plate). The side-walls (52 to 55) and the bottom-plate 51 partition the storage room 50*s* that houses the electronic device 1 as the object to be stored.

Figure 8:
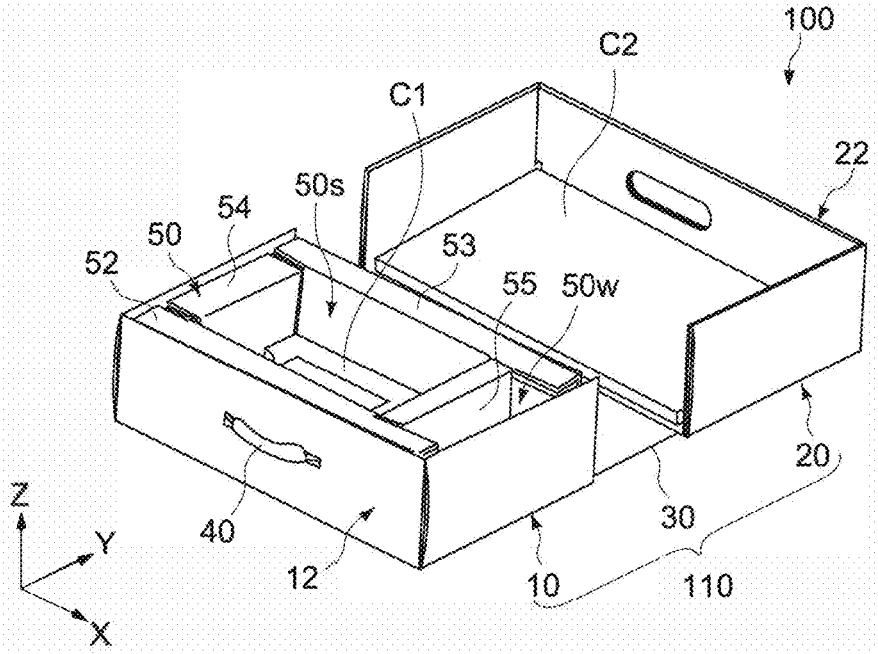
FIG. 8 is a perspective view showing the open state of the storage case.

FIG. 8 is a perspective view showing the open state of the storage case 100.

As shown in FIG. 1 and FIG. 8, the bottom-plate 51 of the cushion member 50 faces to the bottom-plate 11 of the main case 10. The front-plate 52, the back plate 53, and the left and right side-plates 54 and 55 have heights similar to or lower than the height of the side-wall 12 in the state that the cushion member 50 is housed in the main case 10. The front-plate 52 faces to the front-plate 13 of the main case 10, and the back plate 53 faces to the connection plate 30 in the closed state of the storage case 100. The respective both ends of the front-plate 54 and the back plate 55 (both ends facing to the X axis direction) face the side-plates 14 and 15 of the main case 10, and the side-plates 54 and 55 also face to the side-plates 14 and 15 of the main case 10, respectively.

Figure 9:
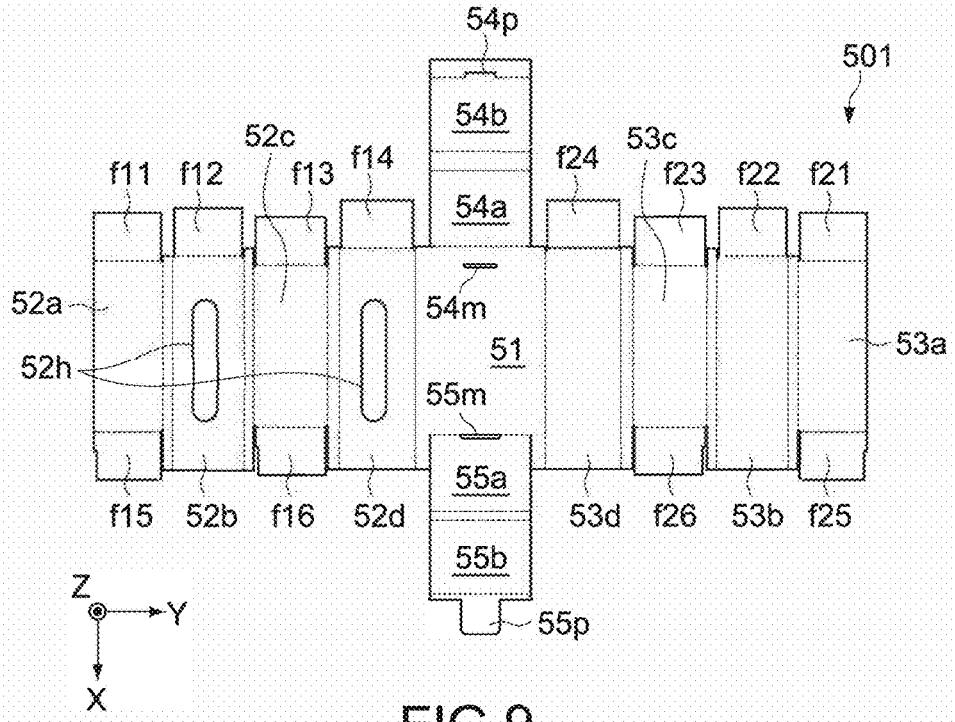
FIG. 9 is a development view of a cushion member of the storage case.
Figure 10A:
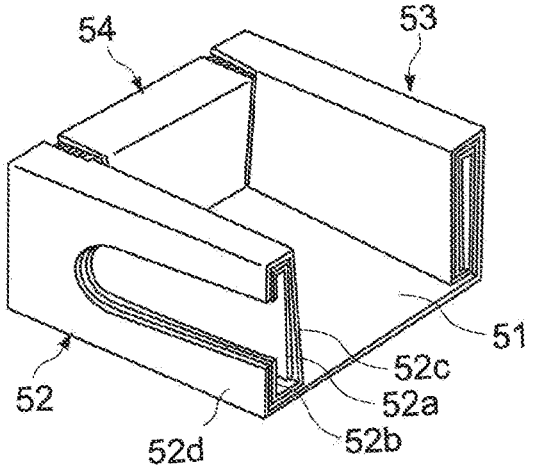
FIGS. 10A and 10B are cross-sectional perspective views showing an inner structure of the cushion member.

FIG. 9 is a development view of the cushion member 50. FIG. 10A is a cross-sectional perspective view of the cushion member 50 showing a section in parallel with the YZ plane, FIG. 10B is a cross-sectional perspective view of the cushion member 50 showing a section in parallel with the XY plane.

Figure 10B:
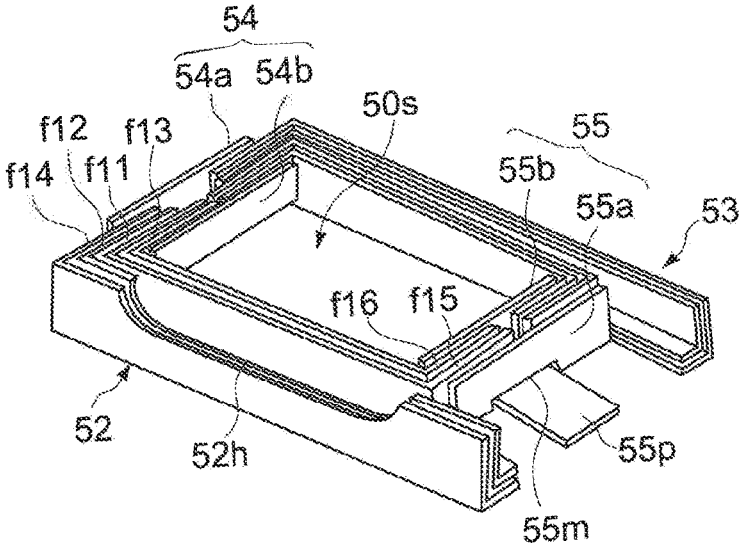
Figure 10B:
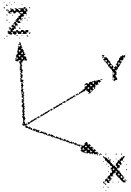

Note that the dotted lines represent the folding lines in FIG. 9, and the hatching of the section is omitted in FIGS. 10A and 10B.

The cushion member 50 is made by folding one cardboard paper sheet 501 (second cardboard paper sheet) shown in FIG. 9 in a predetermined shape. The ridge-extending direction of the cardboard paper sheet 501 is the X axis direction in this embodiment. The front-plate 52 and the back plate 53 are connected with the respective long sides of the bottom-plate 51, and the side-plates 54 and 55 are connected with the respective short sides of the bottom-plate 51.

The front-plate 52 and the back plate 53 have a multilayer structure where four plates 52*a* to 52*d* and four plates 53*a* to 53*d* are laminated by sequentially folding back around the X axis (see FIG. 10A). The plates 52*a* to 52*d* and plates 53*a* to 53*d* have flaps f11 to f14 and flaps f21 to f26 at both ends or at a right side-plate 54 side, each of them is folded at about 90 degrees at the bottom-plate 51 side (see FIG. 10B).

At substantially center portions of the plates 52*b* and 52*d* of the front-plate 52, oval-shaped openings 52*h* each having a long axis in the X axis direction are formed. The openings 52 form one opening by laminating the plates 52*b* and 52*d*, into which the supports 42 of the grip member 40 attached to the front-plate 13 of the main case 10 and both the ends of the handle 41 protruding from the supports 42 can enter. As a result, the grip member 40 is sufficiently flattened, and the cap 20 can be easily open and closed. In addition, the grip member 40 is not protruded toward the storage room 50*s* and can be flattened along with the front-plate 23.

The left and right side-plates 54 and 55 have a multilayer structure where two plates 54*a* and 54*b* and two plates 55*a* and 55*b* are laminated by sequentially folding back around the Y axis (see FIG. 10B). One side-plate 54 keeps the assembled shape by engaging a protrusion 54*p* of a folding piece arranged at an edge of the plate 54*b* with a cut-out portion 54*m* arranged at the bottom-plate 51. The other side-plate 55 keeps the assembled shape by engaging a protrusion 55*p* arranged at an edge of the plate 55*b* with a cut-out portion 55*m* arranged at the bottom-plate 51 (see FIG. 10B).

Between the plates 54*a* and 54*b* forming the outer surface and the inner surface of one side-plate 54, four flaps f11 to f14 of the front-plate 52 and four flaps f21 to f24 of the back plate 53 are interposed. Between the plates 55*a* and 55*b* forming the outer surface and inner surface of the other side-plate 55, two flaps f15 and f16 of the front-plate 52 and two flaps f25 and f26 of the back plate 53 are interposed. Thus, each of the side-plates 54 and 55 has a multilayer structure of the cardboard paper sheet 501.

In addition, the side-plate 55 of the cushion member 50 is a partitioning plate that partitions the space S1 of the main case 10 into two storage rooms, i.e., a storage room 50*s* and an auxiliary storage room 50*w*, as shown in FIG. 8. The auxiliary storage room 50*w* is partitioned by the front-plate 52, the back plate 53, the side-plate 55, the side-wall 12 (side-plate 15) of the main case, and the bottom-plate 11 of the main case 10. The auxiliary storage room 50*w* has a volume smaller than the storage room 50*s* and stores the object to be stored of electronic device 1, for example, accessories (cable, remote controller, or the like).

As described above, the side-plate 55 has an inner structure as the partitioning plate having the number of layers fewer than those of the front-plate 52, the back plate 53, and the side-plate 54. As the front-plate 52, the back plate 53, and the side-plate 54 come in directly contact with the side-wall 12 and the connection plate 30 of the main case 10, in order to adequately protect the electronic device 1 in the storage room 50*s* from an external shock, the front-plate 52, the back plate 53, and the side-plate 54 should have the necessary number of inner layers.

In contrast, as the side-plate 55 faces to the side-wall 12 of the main case 10 through the auxiliary storage room 50*w*, the number of inner layers necessary to protect the electronic device from a shock can be decreased. In addition, the number of inner layers of the side-plate 55 can be decreased, and the thickness of the side-plate 55 can be decreased correspondingly. As a result, it is possible to ensure cushioning properties of the side-plate 55 and to increase the volume of the storage room 50*s* or the auxiliary storage room 50*w*.

As shown in FIG. 1 and FIG. 8, the storage case 100 according to this embodiment further includes damping sheets C1 and C2.

One damping sheet C1 is arranged on the inner surface of the bottom-plate 51 of the cushion member 50 and has a plane shape substantially the same as the plane shape of the housing 50*s*. The other damping sheet C2 is arranged on the inner surface of the bottom-plate 21 of the cap 20 of the carton 110 and has a plane shape substantially the same as the plane shape of the bottom-plate 21.

The damping sheets C1 and C2 wrap the electronic device 1 within the storage room 50*s* in Z axis direction in the closed state of the storage case 100 and thus have a function to protect the electronic device 1 from a shock acting on the bottom-plate 11 of the main case 10, or 21 of the cap 20.

In this embodiment, the damping sheet C2 comes in contact with an upper surface of the cushion member 50 in the closed state of the storage case 100. As a result, since the cushion member 50 is sandwiched between the bottom-plate 11 of the main case 10 and the bottom-plate 21 of the cap 20, it is possible to inhibit misalignment of the cushion member 50 in the carton 110.

(Opening and Closing of Storage Case)

In the storage case 100 having the above-described structure, the carton 110 has the structure where the main case 10 is connected together to the cap 20 via the connection plate 30. According to this embodiment, since the connection plate 30 is foldably to the bottom-plate 11 of the main case 10 and the bottom-plate 21 of the cap 20, the main case 10 and the cap 29 can be horizontally positioned at the time of opening, as shown in FIG. 2. Accordingly, as the main case 10 does not tilt or move, taken-out operability and storing operability of the object to be stored (electronic device 1) into the storage room 50*s* are improved.

In addition, according to this embodiment, as shown in FIG. 5, even in an intermediate state that the connection plate 30 is fallen horizontally and the cap 20 is stood straight, the main case 10 can be opened. Accordingly, even in a case where there is no sufficient space to widen the cap 20, the object to be stored can be easily taken-out or stored.

On the other hand, when the storage case 100 is closed, the cap 20 fits to the main case 10 such that the side-wall 12 of the main case 10 is housed in the space S2 of the cap 20. As a result, the side-wall 12 of the main case 10 and the side-wall 22 of the cap 20 are faced each other, and the space S1 of the main case 10 is closed by the cap 20.

Thus, the three side-walls excluding the connection plate 30 of the storage case 100 are made of a double structure having the side-walls 12 and 22, the stiffness of the three side-walls is improved, and the electronic device 1 inside can be effectively protected from a shock applied thereto. Also, the shock applied to the bottom-plates 11 and 21 of the storage case 100 is effectively absorbed by the damping sheets C1 and C2, and the electronic device 1 can also be protected from the shock applied to the bottom-plates 11 and 21.

After the cap 20 is fit to the main case 10, the grip member 40 is drawn out from the standby position where the grip member 40 enters into the front-plate 13 to the normal position where the grip member 40 is protruded outside through the insertion holes 23*h* formed at the front-plate 23 of the side-wall 22 (see FIG. 4). This allows the closed state of the storage case 100 to be locked and the storage case 100 can be transported via the grip member 40 with a single hand. Accordingly, the cap 20 is prevented from carelessly opening, and the portability of the carton 110 can be improved.

According to this embodiment, all of the carton 110 and the cushion member 50 are made of the cardboard paper sheets 111 and 501. While the necessary strength is ensured, the weight of the storage case 100 can be reduced. In addition, when the storage case 100 is transported, a load corresponding to an own weight of the electronic device 1 is applied to the connection plate 30. Since the connection plate 30 has the multilayer structure of the cardboard paper sheet 111, the necessary strength is adequately ensured.

In particular, according to this embodiment, the facing position (seam joint) of the plates 32 and 33 forming the inner surface of the connection plate 30 is one-sided to an auxiliary storage room 50*w* side (see FIG. 3). As a result, it is avoided to directly apply the load exerted by the electronic device 1 in the storage room 50*s* to the facing position. It is thus possible to ensure the stiffness of the connection plate 30 to which the largest load is applied when the storage case 100 is carried.

Furthermore, according to this embodiment, the fixed structure of the front-plate 23 and the both side-plates 24 of the cap 20 utilize an engagement action between the cut-out portion 23*m* and the protrusion 24*p* and between the cut-out portion 23*m* and the protrusion 25*p*. Thus, the protrusions 24*p* and 25*p* enter into the cut-out portions 23*m*, and are avoided to expose to inside of the cap 20. This prevents the protrusions 24*p* and 25*p* from folding, and an adequate fitting state of the main case 10 and the cap 20 is ensured when the storage case 100 is closed.

Figure 11:
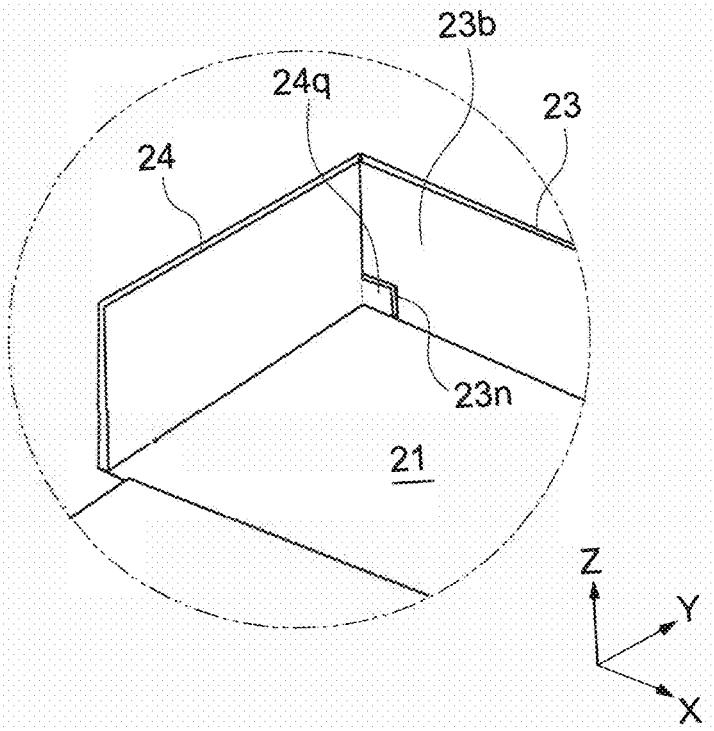
FIG. 11 is a perspective view showing a main part of a fixed structure of a front-plate and side-plates of a cap according to Comparative Embodiment.
Figure 12:
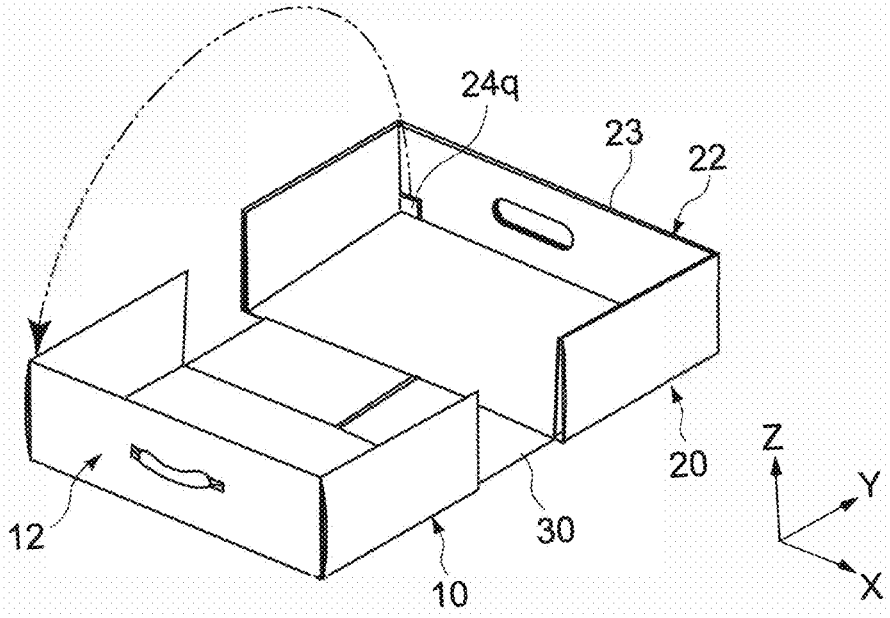
FIG. 12 is a perspective view for illustrating a closing operation of the cap.
Figure 13:
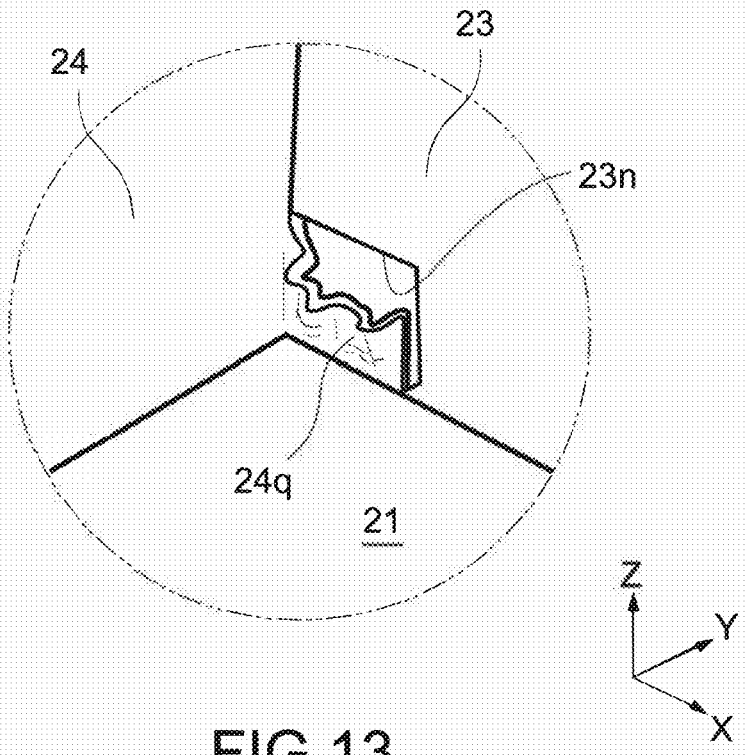
FIG. 13 is a perspective view showing a main part of a cap according to Comparative Embodiment for illustrating problems.

In contrast, as shown in FIG. 11, in the fixed structure where protrusions 24*q* of the side-plate 24 are folded and engaged with cut-out portions 23*n* of the front-plate 23 in the Z axis direction, as shown in FIG. 12, every time the cap 20 is closed, the protrusions 24*q* come in contact with the side-wall 12 of the main case 10. Therefore, the protrusions 24*q* are easily disengaged with the cut-out portions 23*n*. In addition, when the cap 20 is closed in the disengaged state, as shown in FIG. 13, not only one of the protrusions 24*q* is collapsed in the Z axis direction, but also the cap 20 is no more adequately closed. According to this embodiment, the problems are solved, and it ensures an adequate closing operation of the cap 20 for a long period of time and an adequate fitting state between the main case 10 and the cap 20 upon storage.

Second Embodiment

Figure 14:
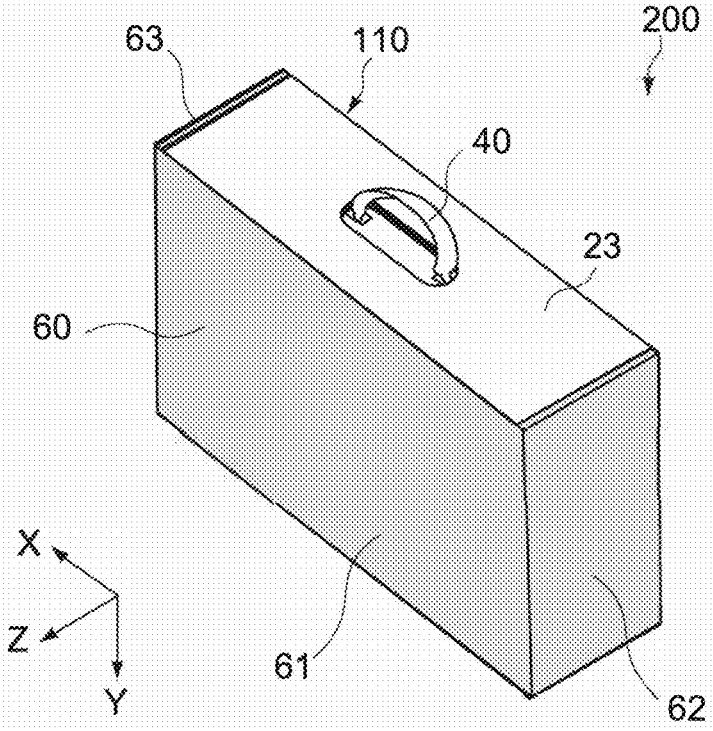
FIG. 14 is a perspective view of a storage case according to another embodiment of the present technology.

FIG. 14 is a perspective view of a storage case according to another embodiment of the present technology.

Hereinafter, configurations different from the first embodiment will be mainly described. Configurations similar to the above-described embodiment are denoted by the similar reference signs, and description thereof will be omitted or simplified.

A storage case 200 of this embodiment is different from the first embodiment in that a cover sheet 60 is included. The configurations other than the cover sheet 60 are similar to the above-described first embodiment, and description thereof will be here omitted.

Figure 15:
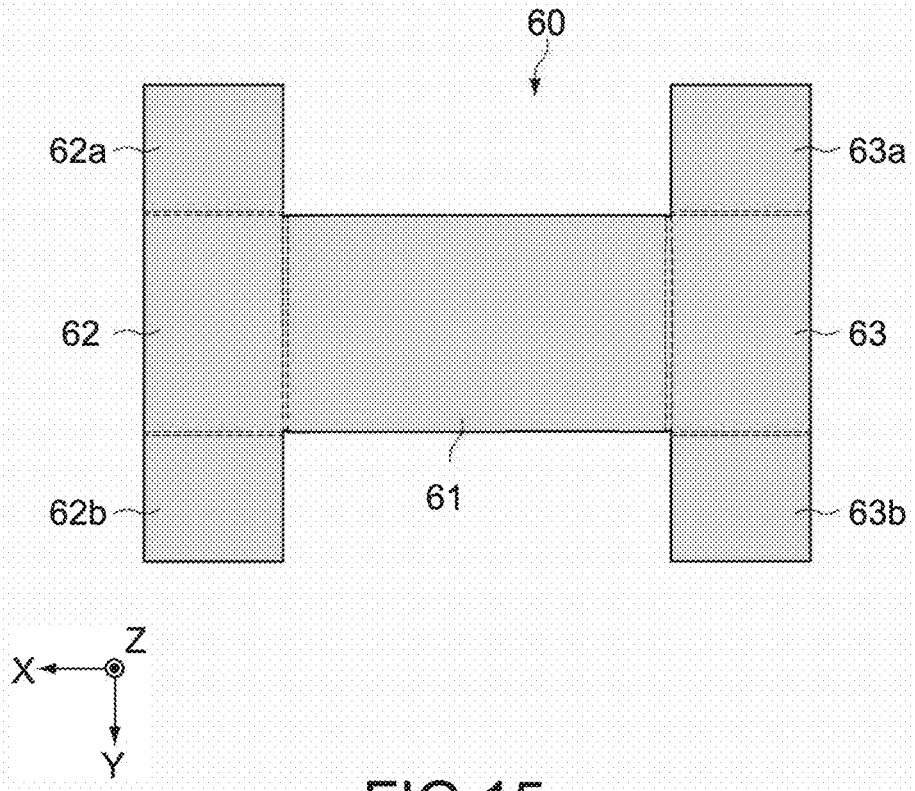
FIG. 15 is a development view of a cover sheet of the storage case.
Figure 16:
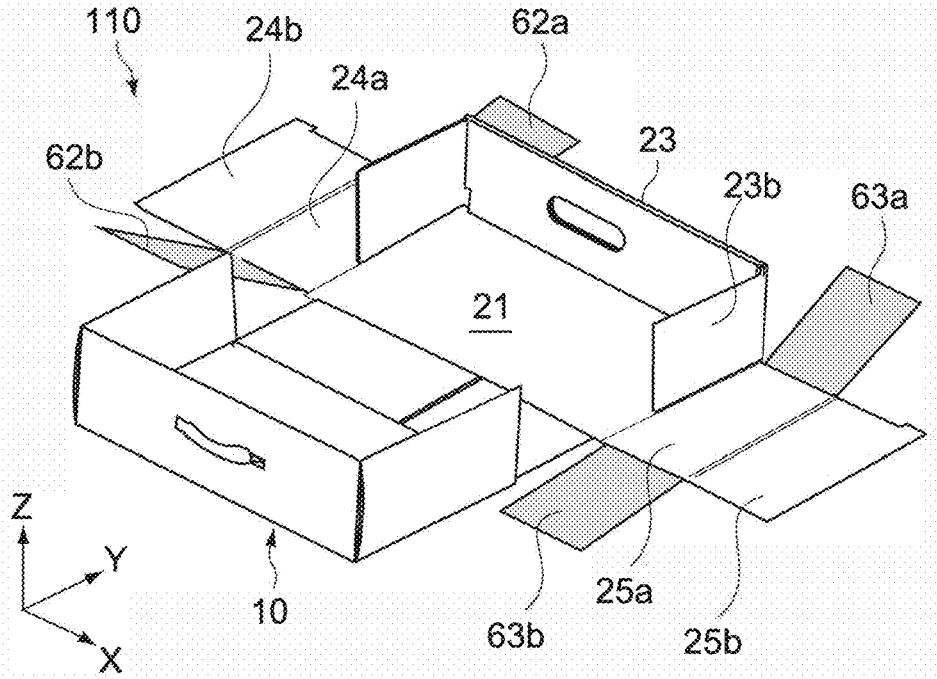
FIG. 16 is a perspective view for illustrating a method of attaching the cover sheet.
Figure 17:
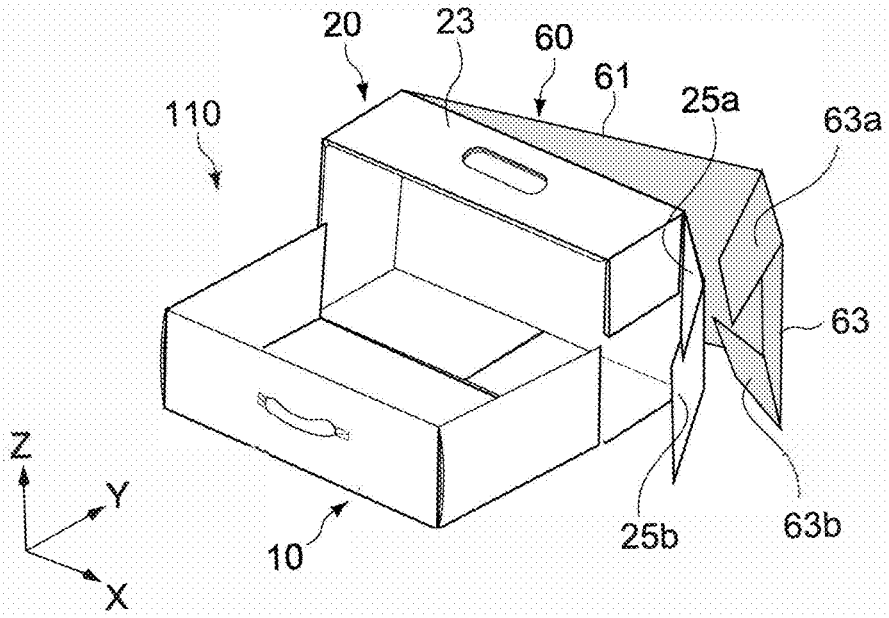
FIG. 17 is other perspective view for illustrating a method of attaching the cover sheet.

FIG. 15 is a perspective view showing a structure of the cover sheet 15, FIG. 16 and FIG. 17 each is a perspective view for illustrating a method of attaching the cover sheet 15 to the carton 110.

Note that dotted lines represent folding lines in FIG. 15, and the cushion member 50 (FIG. 1) is not shown in FIG. 16 and FIG. 17.

The cover sheet 60 is formed by folding one cardboard paper sheet. The cover sheet 60 is typically used as a product description cover or display advertising on which a photograph, a specification, a manufacturer, or the like of the electronic device 1 stored inside of the carton 110 is printed.

The cover sheet 60 is held on the side-wall 22 (second side-wall) of the cap 20 and arranged at the outer surface of the cap 20. As shown in FIG. 15, the cover sheet 60 includes a main surface 61 arranged at an outer surface side of the bottom-plate 21 of the cap 20, a side-surface 62 arranged at an outer surface of one side-plate 24 of the cap 20, and a side-surface 63 arranged at an outer surface of the other side-surface 25 of the cap 20. The one side-surface 62 is connected with a pair of wings 62*a* and 62*b* held by the one side-plate 24 and faced in the Y axis direction, and the other side-surface 63 is connected with a pair of wings 63*a* and 63*b* held by the other side-plate 25 and faced in the Y axis direction.

The cover sheet 60 of this embodiment is mounted to the cap 20 such that the wings 62*a*, 62*b*, 63*a*, and 63*b* of the both side-surfaces 62 and 63 are sandwiched between the two plates of the side-plates 24 and 25 when the cap 20 is assembled. Specifically, as shown in FIG. 15 and FIG. 16, as to the side-surface 63, the wings 63*a* and 63*b* are sandwiched between the plate 25*a* and the plate 25*b* of the side-surface 25. As to the side-surface 62 as the opposite side, the side-plate 24 similarly holds the wings.

As described above, according to this embodiment, since the cover sheet 60 is easily attachable/detachable to/from the carton 110, the cover sheet 60 can be easily changed or replaced depending on the type or the like of the object to be stored. In addition, one common carton 110 can be used, the carton 110 or the storage case 200 can be provided at low costs.

While the embodiments of the present technology are described above, it should be understood that the present technology is not limited to the above-described embodiments and various changes may be made.

For example, in the above-described embodiments, the carton 110 is an assembly of the cardboard paper sheet but may be other plate material such as a plastic sheet, instead.

In addition, in the above-described embodiments, the cushion member 50 is an assembly of the cardboard paper sheet, but is not limited thereto and may be made of other damping material such as a molded product of a foamable resin material and a filler of powder thereof. Alternatively, the cushion member 50 may be omitted. In this case, a damping material may be attached inside the side-wall 12 of the main case 10.

Furthermore, in the above-described embodiments, the storage room 50*s* is arranged in the space S1 of the main case 10. In addition, the storage room 50*s* may also be arranged in the space S2 of the cap 20. In this case, a cushion member mounted into the space S2 may be separately used.

The present technology may also have the following configurations.

(1) A storage case, including:

a main case having a first bottom-plate having four sides including a first side, a first side-wall including a first side-plate opposite to the first side and being connected with three sides different from the first side, and a first space partitioned by the first bottom-plate and the first side-wall;

a cap having a second bottom-plate having four sides including a second side, a second side-wall including a second side-plate opposite to the second side and being connected with three sides different from the second side, and a second space partitioned by the second bottom-plate and the second side-wall and having a volume larger than a volume of the first space;

a connection plate being connected with each of the first side and the second side and being foldable to the first bottom-plate and the second bottom-plate; and a grip member being attached to the first side-plate and being capable of penetrating into the second side-plate in a closed state in which the first side-wall is housed in the second space.

(2) The storage case according to (1), in which the main case, the cap, and the connection plate include a first cardboard paper sheet, and each of the first side-wall and the second side-wall includes a multilayer structure of the first cardboard paper sheet.

(3) The storage case according to (2), in which the first cardboard paper sheet includes a first plate forming an inner surface of the second side-plate and a pair of second plates forming inner surfaces of a pair of side-plates adjacent to the second side-plate, the first plate has a pair of cut-out portions arranged at both side edges adjacent to the pair of second plates, each having a depth corresponding to the thickness of the first plate, and the pair of second plates have protrusions that engage with the pair of cut-out portions.

(4) The storage case according to according to (2) or (3), in which the connection plate includes a multilayer structure of the first cardboard paper sheet.

(5) The storage case according to any one of (1) to (4), further including:

a cushion member positioned in the first space that partitions a storage room having a volume smaller than the first space.

(6) The storage case according to (5), in which the cushion member has a third bottom-plate facing to the first bottom-plate and a third side-wall facing to the first side-plate into which the grip member is capable of entering.

(7) The storage case according to (6), in which the cushion member includes a second cardboard paper sheet, and the third side-wall includes a multilayer structure of the second cardboard paper sheet.

(8) The storage case according to (7), in which the third side-wall further includes a fourth side-plate facing to the third side-plate that is overlapped with the connection plate in the closed state, a fifth side-plate arranged between the third side-plate and the fourth side-plate, and a partitioning plate facing to the fifth side-plate that partitions the storage room into a plurality of storage rooms, and the fifth side-plate includes more layers than the partitioning plate.

(9) The storage case according to any one of (5) to (8), further including:

a damping sheet arranged at the second bottom-plate that comes in contact with the cushion member in the closed state.

(10) The storage case according to any one of (1) to (9), further including:

a cover sheet held on the second side-wall and arranged at an outer surface of the cap.

REFERENCE SIGNS LIST

1 electronic device
10 main case
11, 21 bottom-plate
13, 23 front-plate
14, 15, 24, 25 side-plate
20 cap
30 connection plate
40 grip member
50 cushion member
50*s* storage room
60 cover sheet
100, 200 storage case
110 carton
C1, C2 damping sheet
S1, S2 space

The invention claimed is:

1. A storage case, comprising:

a main case having:

a first bottom-plate having four sides, wherein the four sides include a first side and three sides different from the first side, a first side-wall including a first side-plate opposite to the first side, wherein the first side-wall is connected with the three sides of the first bottom-plate, and a first space bounded by the first bottom-plate and the first side-wall;

a cap having:

a second bottom-plate having four sides, wherein the four sides of the second bottom-plate include a second side and three sides different from the second side, a second side-wall including a second side-plate opposite to the second side, wherein the second side-wall is connected with the three sides of the second bottom-plate, and a second space bounded by the second bottom-plate and the second side-wall, wherein the second space has a volume larger than a volume of the first space;

a cushion member in the first space, wherein the cushion member comprises:

a third bottom-plate which faces the first bottom-plate, a third side-wall including four sides connected to the third bottom-plate, wherein the third side-wall faces the first side-plate, and a storage room bounded by the third side-wall and the third bottom-plate, wherein the storage room has a volume smaller that the volume of the first space;

a connection plate connected with each of the first side and the second side, wherein the connection plate is foldable to the first bottom-plate and the second bottom-plate; and a grip member attached to the first side-plate, wherein the grip member penetrates into the second side-plate in a closed state in which the first side-wall is housed in the second space.

2. The storage case according to claim 1, wherein the main case, the cap, and the connection plate include a first cardboard paper sheet, and each of the first side-wall and the second side-wall includes a multilayer structure of the first cardboard paper sheet.

3. The storage case according to claim 2, wherein the first cardboard paper sheet includes a first plate that is an inner surface of the second side-plate and a pair of second plates that is inner surfaces of a pair of side-plates adjacent to the second side-plate, the first plate includes a pair of cut-out portions arranged at both side edges adjacent to the pair of second plates, each of the pair of cut-out portions has a depth corresponding to a thickness of the first plate, and the pair of second plates have protrusions that engage with the pair of cut-out portions.

4. The storage case according to claim 2, wherein the connection plate includes a multilayer structure of the first cardboard paper sheet.

5. The storage case according to claim 1, wherein the cushion member includes a second cardboard paper sheet, and the third side-wall includes a multilayer structure of the second cardboard paper sheet.

6. The storage case according to claim 5, wherein the third side-wall includes a third side-plate, a fourth side-plate facing the third side-plate that is overlapped with the connection plate in the closed state, a fifth side-plate between the third side-plate and the fourth side-plate, and a partitioning plate facing the fifth side-plate that partitions the storage room into a plurality of storage rooms, and the fifth side-plate includes more layers than the partitioning plate.

7. The storage case according to claim 1, further comprising:

a damping sheet at the second bottom-plate that is in contact with the cushion member in the closed state.

8. The storage case according to claim 1, further comprising:

a cover sheet on the second side-wall, wherein the cover sheet is at an outer surface of the cap.

* * * * *